United States Patent [19]

Fringeli et al.

[11] Patent Number: 5,053,055

[45] **Date of Patent: * Oct. 1, 1991**

[54] WHITENER DISPERSION

[75] Inventors: Werner Fringeli, Laufen, Switzerland; Martin Jöllenbeck, Solingen, Fed. Rep. of Germany

[73] Assignee: Ciba-Geigy Corporation, Ardsley, N.Y.

[ * ] Notice: The portion of the term of this patent subsequent to Sep. 24, 2008 has been disclaimed.

[21] Appl. No.: 275,236

[22] Filed: Nov. 22, 1988

[30] Foreign Application Priority Data

Nov. 27, 1987 [CH] Switzerland ..... 4631/87

[51] Int. Cl.[5] ..... C09B 57/00; C09K 11/04

[52] U.S. Cl. ..... 8/648; 252/301.21; 252/301.22; 252/301.23; 252/301.24; 252/301.23; 252/301.24; 8/922

[58] Field of Search ..... 252/301.21, 301.22, 252/301.23, 301.24; 8/922, 553, 648

[56] References Cited

U.S. PATENT DOCUMENTS 4,070,319 1/1978 Carel et al. ..... 252/301.21
4,330,427 5/1982 Martini et al. ..... 252/301.24

FOREIGN PATENT DOCUMENTS 2745872 10/1979 Fed. Rep. of Germany .
2816746 10/1979 Fed. Rep. of Germany .

OTHER PUBLICATIONS

Kirk-Othmer, Encyclopedia of Chemical Technology, 3rd ed., vol. 4, pp. 213-225, J. Wiley & Sons, New York (1980).

*Primary Examiner*—John F. Niebling
*Assistant Examiner*—Steven P. Marquis
*Attorney, Agent, or Firm*—George R. Dohmann; Edward McC. Roberts

[57] ABSTRACT

There are disclosed aqueous dispersions comprising water-insoluble or sparingly soluble fluorescent whitening agents, dispersants, further optional assistants and a copolymer of 2-vinylpyrrolidone and 3-vinylpropionic acid, their preparation and the use thereof for whitening textile fibre materials. These novel dispersions are storage-stable.

16 Claims, No Drawings

WHITENER DISPERSION

The present invention relates to a stable whitener dispersion and to the preparation thereof, as well as to the use of said dispersion for whitening textile fibre materials, especially polyester materials.

Aqueous dispersions of water-insoluble or sparingly soluble fluorescent whitening agents are known (DE-AS 2 745 872 and DE-OS 2 816 746). The drawbacks of these dispersions are, for example, their poor storage stability and their poor whitening action in the temperature range from 160°-190° C. in the pad thermosol process.

It has now been found that, surprisingly, the addition of specific synthetic copolymers eliminates these drawbacks. The novel dispersions are stable for several months at temperatures up to 40° C. and, when applied by a pad thermosol process, produce a higher degree of white on polyester fibre material than known whitener dispersions, even despite the use of identical fluorescent whitening agents in identical concentrations.

Accordingly, the present invention relates to a novel, stable aqueous dispersion comprising at least one water-insoluble or sparingly soluble fluorescent whitening agent, at least one anionic, cationic and/or non-ionic dispersant as well as further optional assistants, which dispersion additionally comprises a copolymer of 2-vinylpyrrolidone and 3-vinylpropionic acid.

The dispersion of this invention preferably contains 4–20% of water-insoluble or sparingly insoluble fluorescent whitening agent, 2–20% of dispersant, 1–15% of a copolymer of 2-vinylpyrrolidone and 3-vinylpropionic acid, and 0.1–25% of further assistants. A particularly preferred dispersion comprises 8–15% fluorescent whitening agent, 2–10% of dispersant, 2–10% of copolymer of 2-vinylpyrrolidone and 3-vinylpropionic acid, and 0.1–20% of further assistants. In this context and throughout this specification, percentages are by weight.

The water-insoluble or sparingly soluble fluorescent whitening agents are compounds or mixtures of compounds, for example of the class of the stilbenes, distyrylbenzenes, diphenylbistyryls, triazinyls, benzoxazoles, bis(benzoxazoles), bis(benzoxazolyl)thiophenes, bis(-benzoxazolyl)naphthalenes, pyrenes, coumarins and naphthalene-peridicarboximides. Preferred compounds are those of formulae:

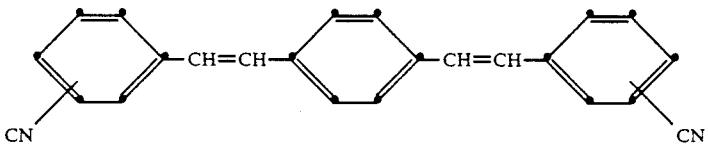

(1)

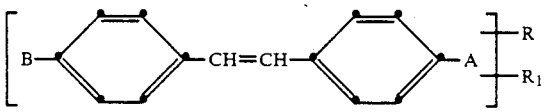

(2)

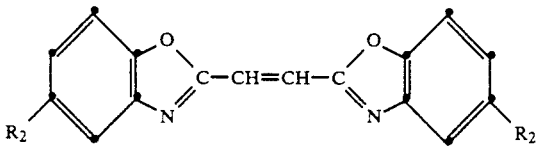

(3)

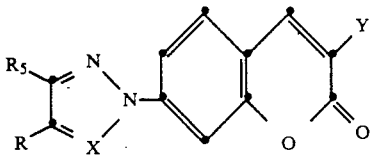

(4)

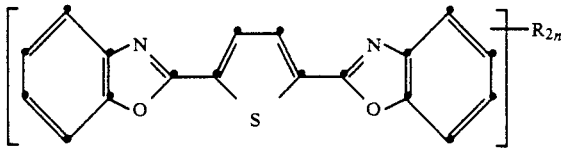

(5)

-continued (6)

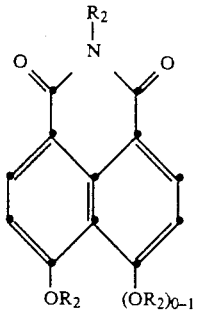

(7)

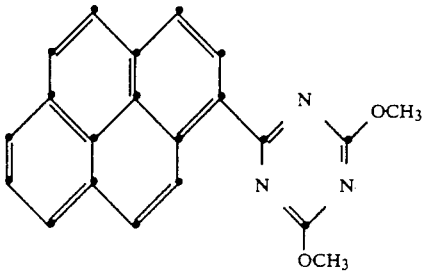

wherein

A = 2-benzoxazolyl, —CH=CH—CN, —CH=CH—$COOR_2$, —$COOR_2$ or halogen,

B = phenyl if A is 2-benzoxazolyl,

B = —CH=CH—CN if A is —CH=CH—CN,

B = —CH=CH—$COOR_2$ if A is —CH=CH—$COOR_2$,

B = 2-benzoxazolyl if A is —$COOR_2$,

B = naphthalene-triazolyl if A is halogen or —$COOR_2$,

B = 1,2,4-oxadiazole if A is 2-benzoxazolyl, and

R = H, $C_1$–$C_4$alkyl, $R_1$ = H, $C_1$–$C_4$alkyl and CN, $R_2$ = $C_1$–$C_4$alkyl, $R_5$ = $C_1$–$C_4$alkyl or phenyl,

X = C, N

Y = phenyl or a radical of formula

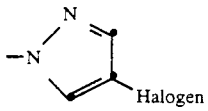

and n = 0–2.

Particularly interesting compounds are those of formulae:

(8)

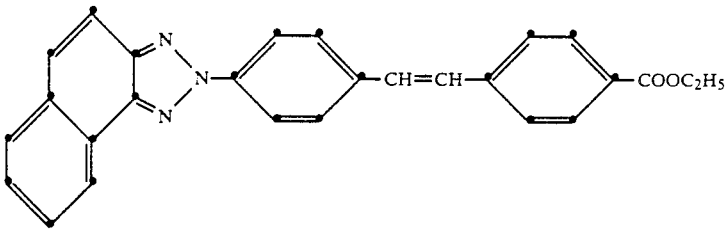

(9)

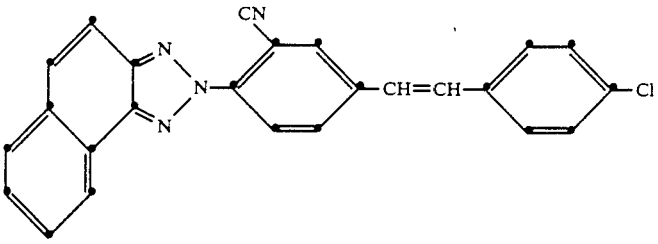

(10)

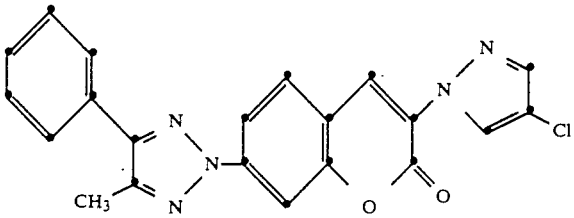

-continued
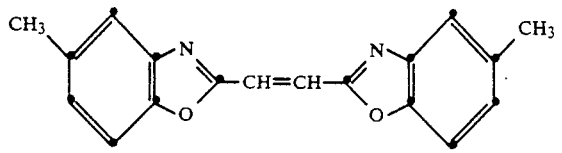
(11)
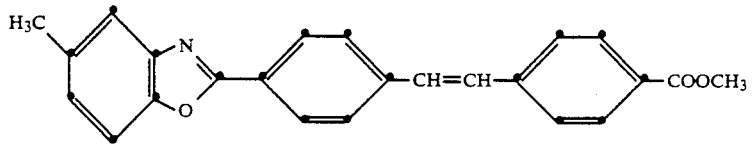
(12)
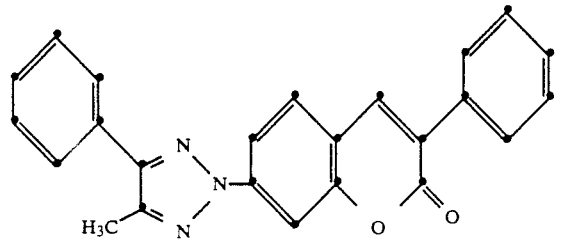
(13)
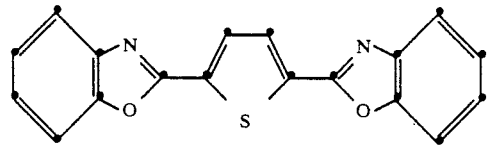
(14)
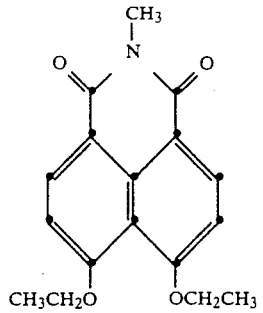
(15)
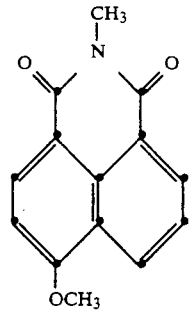
(16)
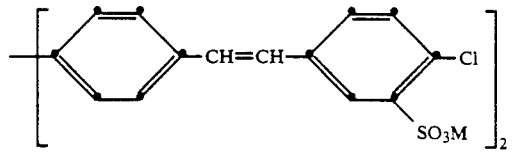
(17)

-continued
(18)
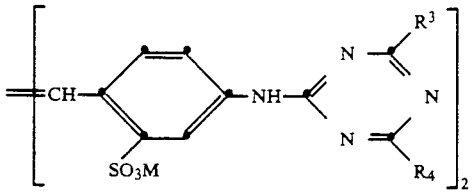
wherein $R_3 = R_4 =$ —NH— 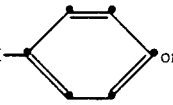 or $R_3 =$ —NH— 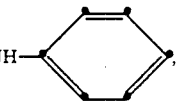 ,
$R_4 =$ —N 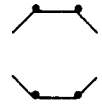
and M is Li, Na, K, ammonium or $C_1$–$C_4$alkylammonium, as well as the mixtures I to VI of compounds of formulae:
I
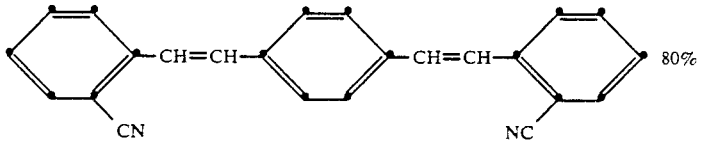
80%
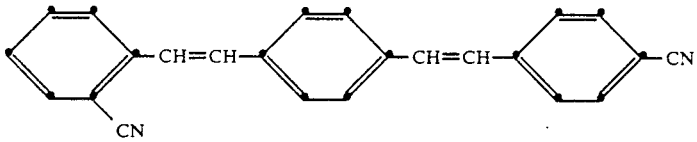
20%
II
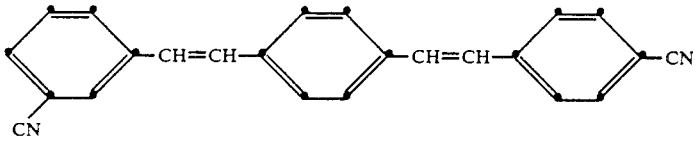
80%
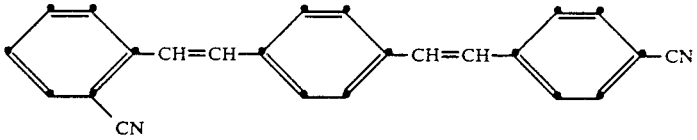
20%
III
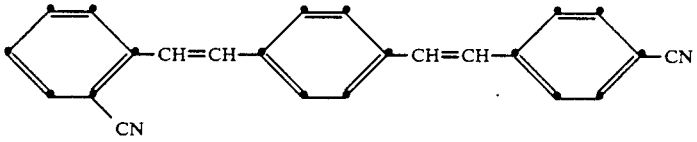
27%
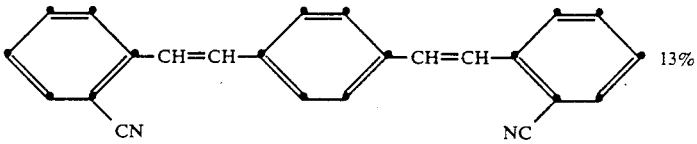
13%
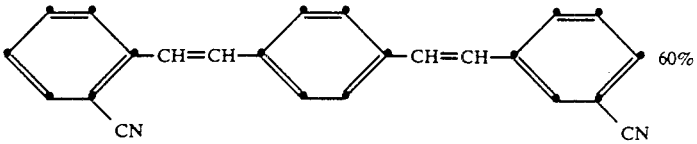
60%

-continued

IV

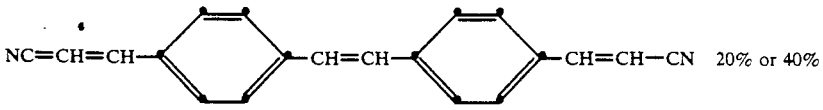

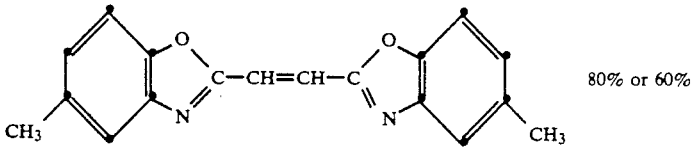

V

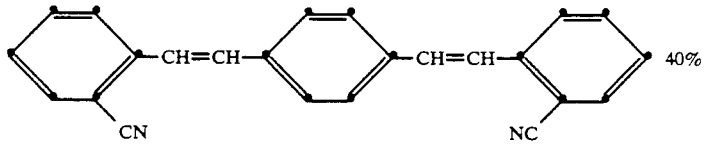

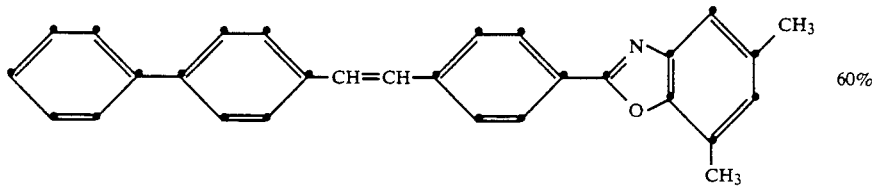

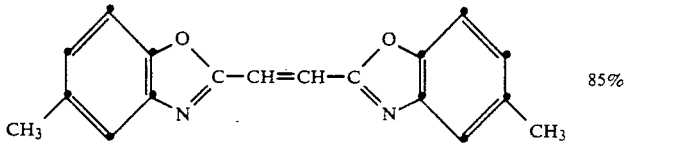

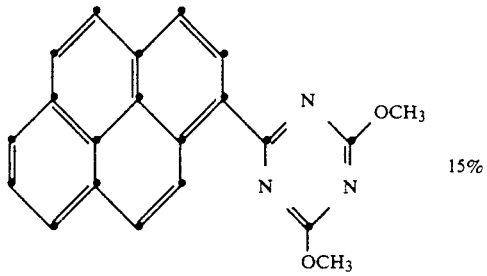

The cationic, anionic and/or non-ionic dispersants are the customary dispersants for water-insoluble or sparingly soluble fluorescent whitening agents.

Examples of anionic suitable dispersants are condensates of aromatic sulfonic acids with formaldehyde as well as ligninsulfonates. Particularly suitable anionic dispersants are condensates of formaldehyde with naphthalenesulfonic acid as well as dihexylsulfosuccinates.

Suitable cationic dispersants are, for example, quaternary fatty amine polyglycol ethers.

It is preferred, however, to use non-ionic dispersants, for example: ethylene oxide adducts of the class of adducts of ethylene oxide with higher fatty acids, saturated or unsaturated fatty alcohols, mercaptans, fatty acid amides, fatty acid alkylolamides or fatty amines, or with alkylphenols or alkylthiophenols in which the alkyl moiety contains at least 7 carbon atoms, which adducts contain preferably 5 to 100 mol of ethylene oxide per 1 mol of the cited compounds, as well as block polymers of ethylene oxide and propylene oxide and polyadducts of ethylenediamine, ethylene oxide and propylene oxide. Individual ethylene oxide units can be replaced by other epoxides, for example styrene oxide or, preferably, propylene oxide.

Representative individual ethylene oxide adducts are:

a) adducts of saturated and/or unsaturated $C_8$–$C_{20}$ fatty alcohols with 20 to 100 mol of ethylene oxide per mol of alcohol, preferably of saturated linear $C_{16}$–$C_{18}$ alcohols with 25 to 80 mol, preferably 25 mol, of ethylene oxide per mol of alcohol;

b) adducts of saturated and/or unsaturated $C_8$–$C_{20}$ fatty acids with 5 to 20 mol of ethylene oxide per mol of acid, preferably ethoxylated castor oil;

c) adducts of alkylphenols containing 7 to 12 carbon atoms in the alkyl moiety with 5 to 25 mol of ethylene oxide per mol of phenolic hydroxy group, preferably of mono- or dialkylphenols with 10 to 20 mol of ethylene oxide per mol of phenolic hydroxy group;

d) adducts of saturated and/or unsaturated $C_8$–$C_{20}$ fatty acid amides with 5 to 20 mol of ethylene oxide per mol of acid amide, preferably of oleylamides with 8 to 15 mol of ethylene oxide per mol of acid amide;

e) adducts of saturated and/or unsaturated $C_8$–$C_{20}$ fatty amines with 5 to 20 mol of ethylene oxide per mol of amine, preferably of oleylamines with 8 to 15 mol of ethylene oxide per mol of amine;

f) block polymers of ethylene oxide and propylene oxide with 10–80% of ethylene oxide and having molecular weights of 1,000 to 80,000;

g) polyadducts of ethylene oxide and propylene oxide with ethylenediamine.

The adducts cited in a) are preferred. It is also possible to use mixtures of the adducts of a) to g).

The dispersion of this invention may also contain further assistants, for example textile auxilaries, shading dyes, foam inhibitors and, especially, anti-freeze agents such as polyols, preferably di- or polyalcohols such as ethylene glycol, propylene glycol, diethylene glycol, glycerol and/or sorbitol, humectants, surfactants, for example polyethylene glycols having molecular weights in the range from 200 to 6 000, and/or microbicides such as chloroacetamide or aqueous formaldehyde solutions, as well as fungicides.

The salient feature of the invention is that the whitener dispersion contains a copolymer of 2-vinylpyrrolidone and 3-vinylpropionic acid. Such copolymers are known and can be prepared by known methods.

The dispersion of this invention is prepared, for example, a) by mixing the separately prepared and formulated individual components or b) by jointly formulating the individual components, for example by grinding them to a particle size of less than 5 μm in a microsol mill, bead mill, sand mill or dynomill.

The dispersion of this invention is used for whitening textile fibre materials, preferably polyester fibre material. The dispersion is applied by known methods of application, preferably by a pad thermosol process. It is also possible to whiten polyester/cellulose blends. Application in this case is made either by a single step process by adding a fluorescent whitening agent for cellulose to the dispersion and then whitening the polyester component and the cellulose component simultaneously, or by a two-step process in which the polyester component is whitened with the dispersion in a first step and the cellulose component is whitened in a second step by adding the fluorescent whitening agent for cellulose.

The invention is illustrated by the following non-limitative Examples, in which parts and percentages are by weight.

EXAMPLE 1

40 parts of a mixture I comprising 80% of the fluorescent whitening agent of formula

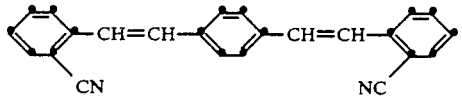

and 20% of the fluorescent whitening agent of formula

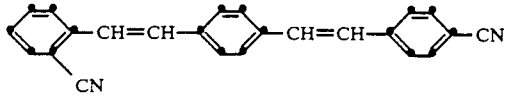

20 parts of the adduct of a $C_{16}$–$C_{18}$fatty alcohol with 25 mol of ethylene oxide (HLB ca. 16), 20 parts of 1,2-propylene glycol, 32 parts of a 30% aqueous copolymer of 2-vinylpyrrolidone and 3-vinylpropionic acid, 2 parts of 37% formaldehyde and 286 parts of water are mixed in a microsol mill until the fluorescent whitening agents have a particle size smaller than 5 μm. The glass beads are then separated, affording a homogeneous, readily pourable and pumpable liquid formulation having a 10% content of fluorescent whitening agent. This formulation is stable for several months at room temperature and 40° C.

EXAMPLE 2

10 parts of a mixture II comprising 80% of the fluorescent whitening agent of formula

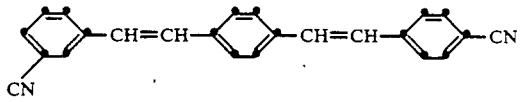

and 20% of the fluorescent whitening agent of formula

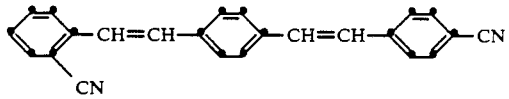

5 parts of the adduct of a $C_{16}$–$C_{18}$fatty alcohol with 25 mol of ethylene oxide (HLB ca. 16), 5 parts of 1,2-propylene glycol, 0.5 part of 37% formaldehyde, 8 parts of a 30% aqueous copolymer of 2-vinylpyrrolidone and 3-vinylpropionic acid and 71.5 parts of water are ground in a stirred ball mill. After grinding to the desired particle size, the dispersion is sieved to separate the grinding elements. The resultant dispersion has a 10% content of fluorescent whitening agent and is stable for several months at room temperature and 40° C.

EXAMPLE 3

40 parts of the mixture I or II of Example 1 or 2, 20 parts of a non-ionic dispersant as used in Example 1 and 140 parts of water are ground in a microsol mill as described in Example 1. The glass beads are separated, affording a homogeneous, readily pourable and pumpable liquid formulation having a 20% content of fluorescent whitening agent. With stirring, 10 parts of 1,2-propylene glycol, 16 parts of a 30% aqueous copolymer of 2-vinylpyrrolidone and 3-vinylpropionic acid, 1 part of 37% formaldehyde and 73 parts of water are added to 100 parts of the above liquid formulation. The low viscosity dispersion so obtained has a 10% content of fluorescent whitening agent, is stable for a considerable length of time at room temperature and 40° C., and no sedimentation occurs.

The same result is achieved by grinding the dispersion in a bead mill, sand mill or dynomill.

If the copolymer of 2-vinylpyrrolidone and 3-vinylpropionic acid is replaced by the same amount of a polyvinyl alcohol as preferably used in practice, then the dispersion is no longer storage stable and sedimentation occurs after a short time.

EXAMPLE 4

A polyester fabric (Terylene 540) is treated at 40° C. on a dyeing machine at a liquor ratio of 1:20 with an aqueous bath containing 1 g of a whitener formulation according to Example 1, 2 or 3 and 1 g/l of a fatty alcohol polyglycol ether. The temperature is raised to 130° C. over 30 minutes and kept at this level for a further 30 minutes. The bath is then cooled again to 40° C. over 15 minutes. The fabric is aftertreated by rinsing it for 30 seconds in running deionised water, and is then dried at 180° C. An excellent white effect is obtained on the treated polyester fabric.

EXAMPLE 5

A polyester fabric (Terylene 540) is padded at room temperature with an aqueous liquor containing 1 g of a whitener formulation according to Example 1, 2 or 3 and 1 ml/l of an alkylphenol polyglycol ether.

The pick-up is 65%. The fabric is then dried for 30 minutes at 80° C. and subsequently heat-set at 200° C. A better white effect is obtained on the treated polyester fabric than one obtained with a similar formulation which contains a polyvinyl alcohol as preferably used in practice instead of a copolymer of 2-vinylpyrrolidone and 3-vinylpropionic acid.

What is claimed is:

1. A stable dispersion comprising at least one water-insoluble or sparingly soluble fluorescent whitening agent, at least one anionic, cationic or non-ionic dispersant, and further optional assistants, which dispersion additionally comprises a copolymer of 2-vinylpyrrolidone and 3-vinylpropionic acid.

2. A stable dispersion according to claim 1, which comprises 4–20% of fluorescent whitening agent, 2–20% of dispersant, 1–15% of copolymer of 2-vinylpyrrolidone and 3-vinylpropionic acid, and 0.1–25% of further assistants.

3. A stable dispersion according to claim 2, which comprises 8–15% of fluorescent whitening agent, 2–10% of dispersant, 2–10% of copolymer of 2-vinylpyrrolidone and 3-vinylpropionic acid, and 0.1–20% of further assistants.

4. A stable dispersion according to claim 1, wherein the fluorescent whitening agent is a compound or a mixture of compounds selected from the group consisting of the class of the stilbenes, distyrylbenzenes, diphenylbistyryls, triazinyls, benzoxazoles, bis(benzoxazoles), bis(benzoxazolyl)thiophenes, bis(benzoxazolyl)naphthalenes, pyrenes, coumarins and naphthaleneperidicarboximides.

5. A stable dispersion according to claim 4, which contains at least one compound of formula

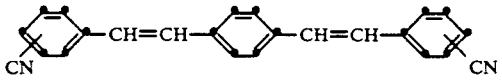

(1)

as fluorescent whitening agent.

6. A stable dispersion according to claim 4, wherein the fluorescent whitening agent is a compound of formula

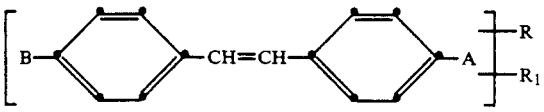

(2)

wherein

A = 2-benzoxazolyl, —CH=CH—CN, —CH=CH—$COOR_2$, —$COOR_2$ or halogen,

B = phenyl if A is 2-benzoxazolyl,

B = —CH=CH—CN if A is —CH=CH—CN,

B = —CH=CH—$COOR_2$ if A is —CH=CH—$COOR_2$,

B = 2-benzoxazolyl if A is —$COOR_2$,

B = naphthalene-triazolyl if A is halogen or —$COOR_2$,

B = 1,2,4-oxadiazole if A is 2-benzoxazolyl, and

R = H, $C_1$–$C_4$alkyl, $R_1$ = H, $C_1$–$C_4$alkyl and CN, $R_2$ = $C_1$–$C_4$alkyl.

7. A stable dispersion according to claim 4, wherein the fluorescent whitening agent is a compound of formula

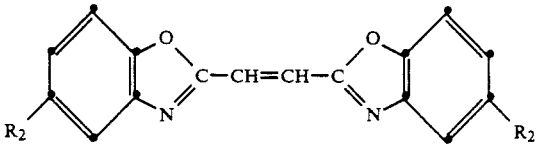

(3)

wherein $R_2$ is $C_1$–$C_4$alkyl.

8. A stable dispersion according to claim 4, wherein the fluorescent whitening agent is a compound of formula

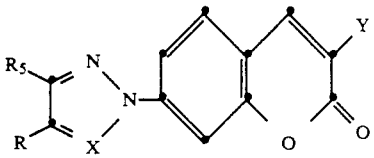

(4)

wherein Y is phenyl or a radical of formula

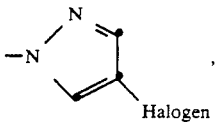

X is C or N, and $R_5$ is $C_1$–$C_4$alkyl or phenyl, and R is H or $C_1$–$C_4$alkyl.

9. A stable dispersion according to claim 4, wherein the fluorescent whitening agent is a compound of formula

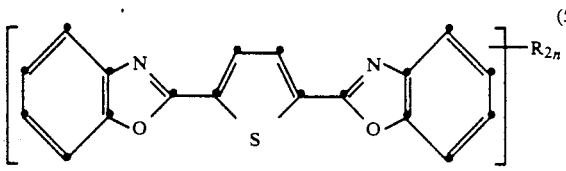

(5)

wherein n is 0 to 2 and $R_2$ is $C_1$–$C_4$alkyl.

10. A stable dispersion according to claim 4, wherein the fluorescent whitening agent is a compound of formula (6)

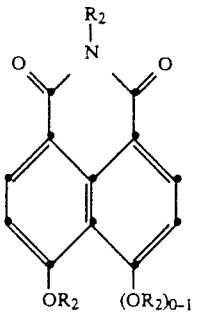

wherein $R_2$ is $C_1$-$C_4$alkyl.

11. A stable dispersion according to claim 4, wherein the fluorescent whitening agent is a compound of formula (7)

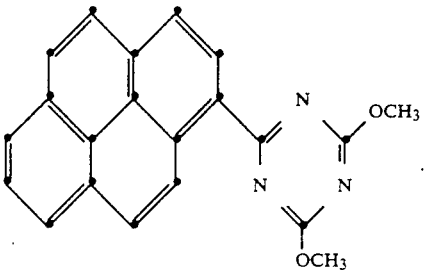

12. A stable dispersion according to claim 4, wherein the fluorescent whitening agent is a compound of formula (17)

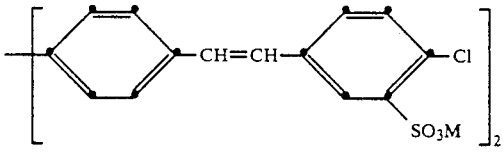

wherein M is Li, Na, K, ammonium or $C_1$-$C_4$alkylammonium.

13. A stable dispersion according to claim 4, wherein the fluorescent whitening agent is a compound of formula (18)

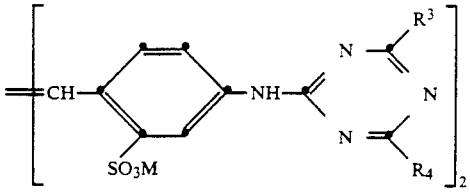

wherein $R_3 = R_4 =$ 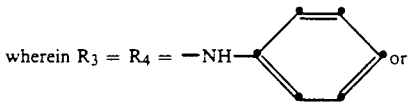

$R_3 =$ 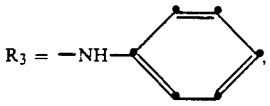

$R_4 =$ 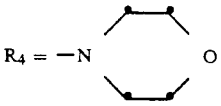

and M is Li, Na, K, ammonium or $C_1$-$C_4$alkylammonium.

14. A stable dispersion according to claim 4, wherein the fluorescent whitening agent is a mixture of compounds of formula (2)

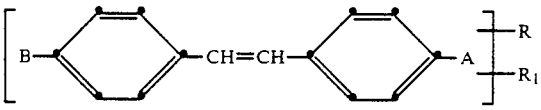

wherein

A = 2-benzoxazolyl, —CH=CH—CN, —CH=CH—$COOR_2$, —$COOR_2$ or halogen,

B = phenyl if A is 2-benzoxazolyl,

B = —CH=CH—CN if A is —CH=CH—CN,

B = —CH=CH—$COOR_2$ if A is —CH=CH—$COOR_2$,

B = 2-benzoxazolyl if A is —$COOR_2$,

B = naphthalene-triazolyl if A is halogen or —$COOR_2$,

B = 1,2,4-oxadiazole if A is 2-benzoxazolyl, and

R = H, $C_1$-$C_4$alkyl, $R_1$ = H, $C_1$-$C_4$alkyl and CN, $R_2$ = $C_1$-$C_4$alkyl, and a compound of formula (1)

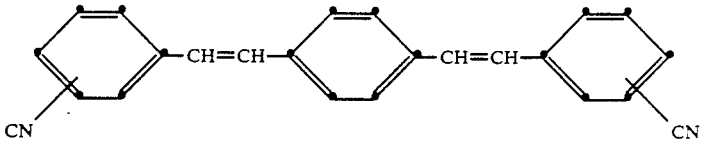

or (3)

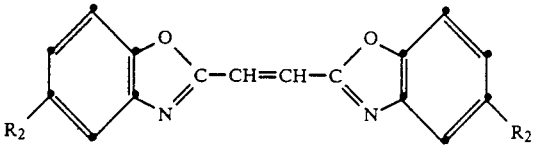

wherein $R_2$ is $C_1$–$C_4$alkyl.

15. A stable dispersion according to claim 4, wherein the fluorescent whitening agent is a mixture of a compound of formula

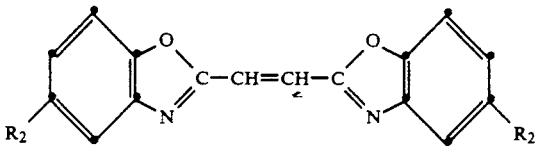

(3)

wherein $R_2$ is $C_1$–$C_4$alkyl, and a compound of formula

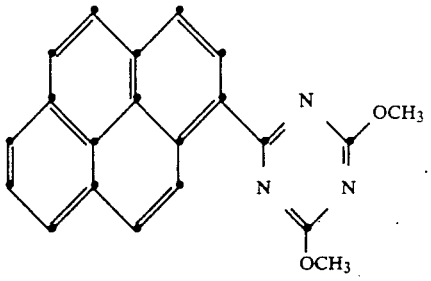

(7)

16. A method for whitening polyester and polyester/-cellulose blends, which comprises the step of applying a stable dispersion to the polyester and polyester/cellulose blends said dispersion comprising at least one water-insoluble or sparingly soluble fluorescent whitening agent, at least one anionic, cationic or non-ionic dispersant and further optional assistants, which dispersion additionally comprises a copolymer of 2-vinylpyrrolidone and 3-vinylpropionic acid.

* * * * *